US006561616B1

(12) United States Patent
Hawkins et al.

(10) Patent No.: US 6,561,616 B1
(45) Date of Patent: May 13, 2003

(54) ACTIVE COMPENSATION FOR CHANGES IN THE DIRECTION OF DROP EJECTION IN AN INKJET PRINTHEAD

(75) Inventors: Gilbert A. Hawkins, Mendon, NY (US); Antonio Cabal, Webster, NY (US); David L. Jeanmaire, Brockport, NY (US); Christopher N. Delametter, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 143 days.

(21) Appl. No.: 09/696,536

(22) Filed: Oct. 25, 2000

(51) Int. Cl.[7] ..... B41J 2/015
(52) U.S. Cl. ..... 347/20
(58) Field of Search ..... 347/20, 14–15, 347/19, 47, 62, 65, 73–78, 82, 101

(56) References Cited

U.S. PATENT DOCUMENTS 3,877,036 A 4/1975 Loeffler et al.
4,238,804 A 12/1980 Warren
4,364,057 A 12/1982 Ebi et al.
4,638,337 A * 1/1987 Torpey et al. ..... 347/65
5,185,615 A 2/1993 Koitabashi et al.
5,250,962 A 10/1993 Fisher et al.
5,412,410 A * 5/1995 Rezanka ..... 347/15
5,592,202 A 1/1997 Erickson
5,831,648 A * 11/1998 Mitani et al. ..... 347/56
5,963,235 A * 10/1999 Chwalek et al. ..... 347/82
6,079,821 A 6/2000 Chwalek et al.
6,126,282 A * 10/2000 Oikawa ..... 347/101
6,142,607 A * 11/2000 Takata et al. ..... 347/47
6,364,470 B1 * 4/2002 Cabal et al. ..... 347/82
6,390,610 B1 * 5/2002 Hawkins et al. ..... 347/82

* cited by examiner

*Primary Examiner*—Lamson Nguyen
*Assistant Examiner*—K. Feggins
(74) *Attorney, Agent, or Firm*—Norman Rushefsky

(57) ABSTRACT

For an inkjet printhead (10) with integral compensation for misdirection of ink drops (37) ejected through at least one nozzle (24) of the printhead (10), a system and method of modifying the nozzle cavity space (32*a*) so as to compensate for the effects of defects in the printhead (10) by altering the direction the ejected ink drops (37). The inkjet printhead (10) comprises at least one reservoir (28) integrated within the membrane (30). The inkjet printhead (10) also comprises a channel (38) extending from the reservoir (28) and terminating in the nozzle cavity (32). A hardening substance (40) within the reservoir (28) and channel (38) is a plastic material having a high thermal expansion coefficient. An internal heater (48) within the reservoir (28) and adjacent the hardening substance (40) is adapted to cause the plastic material (40) to flow in order to form a protrusion (44) of plastic material (40) within the nozzle cavity space (32*a*). Alternatively, the plastic material (40) can be recessed within the channel (38). Thus, the hardening substance (40) is adapted to internally alter the nozzle cavity space (32*a*) and cause ink (34) ejected from the nozzle opening (26) to be deflected with regard to a desired amount of compensation.

32 Claims, 9 Drawing Sheets

ACTIVE COMPENSATION FOR CHANGES IN THE DIRECTION OF DROP EJECTION IN AN INKJET PRINTHEAD

CROSS-REFERENCE TO RELATED APPLICATION

The application is commonly assigned and related to:

1. U.S. patent application Ser. No. 09/696,541, U.S. Pat. No. 6,390,610, entitled "Active Compensation for Misdirection of Drops in an Ink Jet Printhead Using Electrodeposition," by Gilbert A. Hawkins et al, filed Oct. 25, 2000, the entirety of which is incorporated herein by reference; and
2. U.S. patent application Ser. No. 09/696,536, entitled "Active Compensation for Changes in the Direction For Drop Ejection In an Ink Jet Printhead Having Orifice Restricting Member," by Gilbert A. Hawkins et al, filed Oct. 25, 2000, the entirety of which is incorporated herein by reference.

FIELD OF THE INVENTION

This invention relates in general to inkjet printheads and, more specifically, to control in the directionality of ink drops ejected from a printhead in order to improve image quality. More particularly, the invention relates to a method of modifying a nozzle cavity space so as to compensate for the effects of defects in an inkjet printhead by altering the direction of ink drops ejected from a nozzle.

BACKGROUND OF THE INVENTION

Without limiting the scope of the invention, its background is described in connection with inkjet printers, as an example.

Modern color printing relies heavily on inkjet printing techniques. The term "inkjet" as utilized herein is intended to include all drop-on-demand or continuous inkjet printer systems including, but not limited to, thermal inkjet, piezoelectric, and continuous, which are well known in the printing industry. Essentially, an inkjet printer produces images on a receiver medium, such as paper, by ejecting ink droplets onto the receiver medium in an image-wise fashion. The advantages of non-impact, low-noise, low-energy use, and low cost operations, in addition to the capability of the printer to print on plain paper, are largely responsible for the wide acceptance of inkjet printers in the marketplace.

The printhead is the device that is most commonly used to direct the ink droplets onto the receiver medium. A printhead typically includes an ink reservoir and channels, which carry the ink from the reservoir to one or more nozzles. Typically, sophisticated printhead systems utilize multiple nozzles for applications such as high-speed continuous inkjet printer systems, as an example. Continuous inkjet printhead device types include electrostatically controlled printheads and thermally steered printheads. Both printhead types are named according to the means used to steer ink droplets ejected from nozzle openings.

It is well known in the art of inkjet printing that image quality suffers from a failure to accurately control the direction from which ink drops exit the printhead. Variations in the direction of ink drops ejected from a given nozzle from a desired direction of ejection (usually perpendicular to the printhead surface) can occur due to changes in the nozzle during operation, as a result of manufacturing defects present before operation, or both. In most instances, repairs are too difficult and costly, resulting in scrapped parts and decreased manufacturing yields. Accordingly, a cost effective way of increasing printhead lifetimes and printhead production yields would be advantageous.

For any given nozzle, the direction of the exiting ink drop stream is controlled by the physical characteristics of the nozzle. Where misdirection occurs, the ink drops can produce printing artifacts such as random placement errors between subsequent drops from a single nozzle or placement errors of drops from one nozzle with respect to those from another nozzle. Variations in the direction of ink drops ejected from a given nozzle may occur over a variety of time scales. For example, in Bubble Jet printheads, made by Canon Company, rapid variations may occur when bubbles nucleate randomly on the surfaces of heaters, causing random variations in the velocity and direction of ejected ink drops from each nozzle. Variations in the direction of ejected ink drops may also be caused by sources external to the inkjet printhead such as, for example, vibrations of the inkjet printer. It is difficult or impossible to correct such random variations in the direction of ejected ink drops, which typically change rapidly with time.

In other cases, factors causing deviation of the direction of ejected ink drops from a desired direction can occur slowly over a long period of time. Such slowly changing variations may arise, for example, from gradual changes in the material properties of the nozzle, such as changes in the stress of the materials comprising the nozzle or surrounding the nozzle openings, from changes in the resistance of heater materials during operation, or from wear of nozzle materials during operation.

In still other cases, factors causing deviation of the direction of ejected ink drops from a desired direction can be essentially permanent. Deviations caused by manufacturing defects in nozzles, for example defects that alter or vary the shape of the nozzle openings, are essentially permanent. Permanent deviations may also arise after a period of time of operation of a nozzle. For example, a piece of material may become permanently chipped away from a portion of a nozzle after a period of time of operation, or a piece of material may lodge permanently within a nozzle during operation.

Thus, it is desirable to compensate for slowly changing variations in the directionality of ejected ink drops. For slowly changing variations, compensation may be needed from time to time during operation. It is also desirable to compensate for permanent changes in the directionality of ejected ink drops in order to improve image quality and increase manufacturing yield. Compensation cannot be applied before operation of the nozzles, since it is generally not possible to predict the direction and magnitude of deviations in the direction of ejected drops for a particular nozzle, which occur after operation. Compensation applied after or during operation of nozzles is herein referred to as active compensation.

Substantial effort has been directed toward active compensation for slowly changing variations in the direction of drop ejection for drop-on-demand printers, as discussed and illustrated, for example, in U.S. Pat. No. 4,238,804, assigned to Xerox Corporation, and U.S. Pat. No. 3,877,036, assigned to IBM, which teach measuring the position of ejected ink drops and compensating for variations from the ideal direction by electrostatic means. While such electrostatic deflection can be used to direct ink in a desired direction, as is well known in the art, electrostatic deflection in these cases adds mechanical complexity. Also, correction techniques of this type are largely ineffective in cases where large variations in the direction of ejected ink drops occur.

U.S. Pat. No. 5,592,202, assigned to Laser Master Corporation, teaches an electronic means to correct inaccuracies in ink drop placement by advancing or retarding the time of a drop-on-demand actuation pulse. However, this method does not correct variations in both of the directions of ink drop ejection in a plane perpendicular to the direction of drop ejection, as it is more suited to adjusting ink drop placement only in the scan direction of the printhead. Moreover, not all printhead circuits can be easily adapted to control the firing times of individual ink drops, since the firing pulses may be derived from a common clock.

U.S. Pat. No. 5,250,962, assigned to Xerox Corporation, teaches the application of a moveable vacuum priming station that can access groups of nozzles to remove entrained air in one or more nozzles. Although entrained air is known in the art to cause variations in the direction of ink drop ejection, it is only one of many mechanisms causing variations. Also, entrained air principally refers to failure of the ink to fill the printhead, not to a change in the head itself. Removal of trapped air serves to restore the nozzle to its original condition, but does not alter the physical characteristics of the nozzle.

Other prior art techniques for achieving compensation include the selection of one nozzle among a plurality of redundant nozzles for printing a particular imaging pixel, the preferred nozzle having favorable ink drop ejection characteristics. However, redundancy selection techniques of this type are complex in nature and require substantial real estate space on the printhead form factor to implement. Such methods also increase cost and/or reduce productivity.

In the case of continuous inkjet printheads using electrostatic steering of ink drops, as in the current generation of commercialized continuous inkjet printheads, for example those manufactured by Scitex Corporation, compensation for variations in the direction of ejected ink drops from an ideal direction can be accomplished by electrostatic means; and in this case, additional mechanical complexity is not required, since the means of printing itself is based on electrostatic deflection and the required hardware is already in place. Printheads of this type produce electrically charged ink drops, which are deflected using a charged electrode at each nozzle. The electrode voltage is set to one of two discreet values (for example, either 100 volts or 0 volts) each time an ink drop is ejected, causing ink drops to be deflected either in a printing direction (for example, in the case the voltage is 100 volts), or into a gutter (for example, in the case the voltage is 0). To correct for slow or permanent deviations of the direction of ejected drops from a particular nozzle, the voltage corresponding to printing at that nozzle might be set, for example, to 110 volts. The use of electrostatic techniques such as these, however, requires additional voltage control hardware.

In the case of continuous inkjet printheads using thermal steering of ink drops, an electrode apparatus is not already in place, and other means of correction are desired to correct for the effects of slow variations in direction of ink drop ejection, as well as for permanent manufacturing defects.

Accordingly, a need exists for a cost effective method of correcting defects in inkjet printheads to permit compensation in the direction of ink drops ejected from the nozzles. A means of increasing manufacturing yields by permitting active compensation for ink drop ejection misdirection from a nozzle would provide numerous advantages.

SUMMARY OF THE INVENTION

The present invention provides a system and method of modifying nozzle cavity space in order to compensate for the misdirection of ink drops ejected through at least one nozzle of the printhead. With the present invention, printheads that would normally be discarded due to defects that cause ink drop misdirection can be repaired rather than discarded.

Accordingly, disclosed in one embodiment is an inkjet printhead with integral compensation for misdirection of ink drops ejected through at least one nozzle of the printhead. The inkjet printhead comprises a substrate forming a wall, which defines a nozzle adapted for facilitating the flow of ink from an ink reservoir to a nozzle cavity having a nozzle opening via an ink stream pathway. The inkjet printhead also comprises a membrane predisposed over the nozzle having a nozzle cavity to create a resistive barrier against ink flow. The membrane includes the nozzle cavity and the nozzle opening through which ink drops are ejected.

The inkjet printhead further comprises at least one reservoir integrated within the membrane and a channel formed within the membrane underlying an upper layer and extending from the reservoir to a nozzle cavity. The reservoir and channel are initially filled with a hardening substance, which can include a plastic material having a high thermal expansion coefficient.

The inkjet printhead also comprises at least one internal heater, which is predisposed within the reservoir and/or the channel adjacent the hardening substance. The internal heater(s), when operated in a first mode, are adapted to cause the hardening substance to soften and flow. Furthermore, the internal heater(s) are configured to cause the plastic material to expand and enter the nozzle cavity when activated in order to modify the nozzle cavity space; and, when cooled, to remain in the cavity. That is, the plastic material is adapted to either form a protrusion in the nozzle cavity, thereby decreasing the nozzle cavity space. Alternatively, when heat is applied to the heater(s) in a second mode of operation, the plastic material is caused to flow and increase the nozzle cavity space. Thus, the hardening substance is adapted to internally alter the nozzle cavity space and cause ink ejected from the nozzle opening to be deflected with regard to a desired amount of compensation.

In accordance with yet another embodiment, disclosed is a method of modifying the nozzle cavity space of an inkjet printhead having at least one reservoir with a channel so as to compensate for the effects of defects in the printhead by altering the direction of ink drops ejected from a nozzle. Initially, the printhead is tested to determine the ink stream directionality onto a receiver medium, such as paper, from a nozzle opening. Variability in the direction of the ink drops ejected from a nozzle of the inkjet printhead caused by manufacturing defects is then identified. Thus, the amount of misdirection from a nozzle of an inkjet printhead can be quantified and the amount of compensation desired in the direction of ink,ejected from the nozzle opening can be determined.

The method comprises the step of causing ink ejected from the nozzle opening to be deflected with regard to the desired amount of compensation. In one embodiment, an internal heater is activated within a reservoir. The application of heat via the internal heater causes a hardening substance, or plastic material, within the reservoir and channel to protrude into the nozzle cavity. A change in temperature is sustained until the desired amount of compensation is obtained. Thus, the nozzle cavity space is internally modified in order to correct the misdirection of ink ejected from the nozzle opening.

Once the desired amount of compensation has been achieved by modifying the nozzle cavity space, the hardening substance within the channel is cooled. The decrease in temperature causes the hardening substance to freeze in a protruding state, thus decreasing the nozzle cavity space. The step of cooling is then followed by the step of deactivating the internal heater. The elimination of heat causes the hardening substance within the reservoir to harden.

According to another embodiment, the step of causing ink ejected from the nozzle opening to be deflected with regard to the desired amount of compensation further includes the step of heating and cooling the hardening substance, preferably using two heaters, one within the reservoir and one within the channel. This, in turn, causes the hardening substance, or plastic material, within the channel to form a recession. Thus, the nozzle cavity space is increased in order to correct the misdirection of ink ejected from the nozzle opening.

Technical advantages of the present invention include a cost effective method of compensating for the effects of defects in inkjet printheads that would otherwise result in misdirection of ink drops ejected from the nozzles. As such, printing artifacts caused by irregularities in the ink drops landing onto a receiver medium are eliminated.

Other technical advantages include the increase in manufacturing yields as printheads that would be typically discarded can be repaired and used.

BRIEF DESCRIPTION OF THE DRAWINGS

For a more complete understanding of the present invention, including its features and advantages, reference is made to the following detailed description of the invention, taken in conjunction with the accompanying drawings in which.

Corresponding numerals and symbols in these figures refer to corresponding parts in the detailed description unless otherwise indicated.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. These specific embodiments discussed herein are merely illustrative of specific ways to make and use the invention, and do not delimit the scope or application of the invention.

Figure 1:
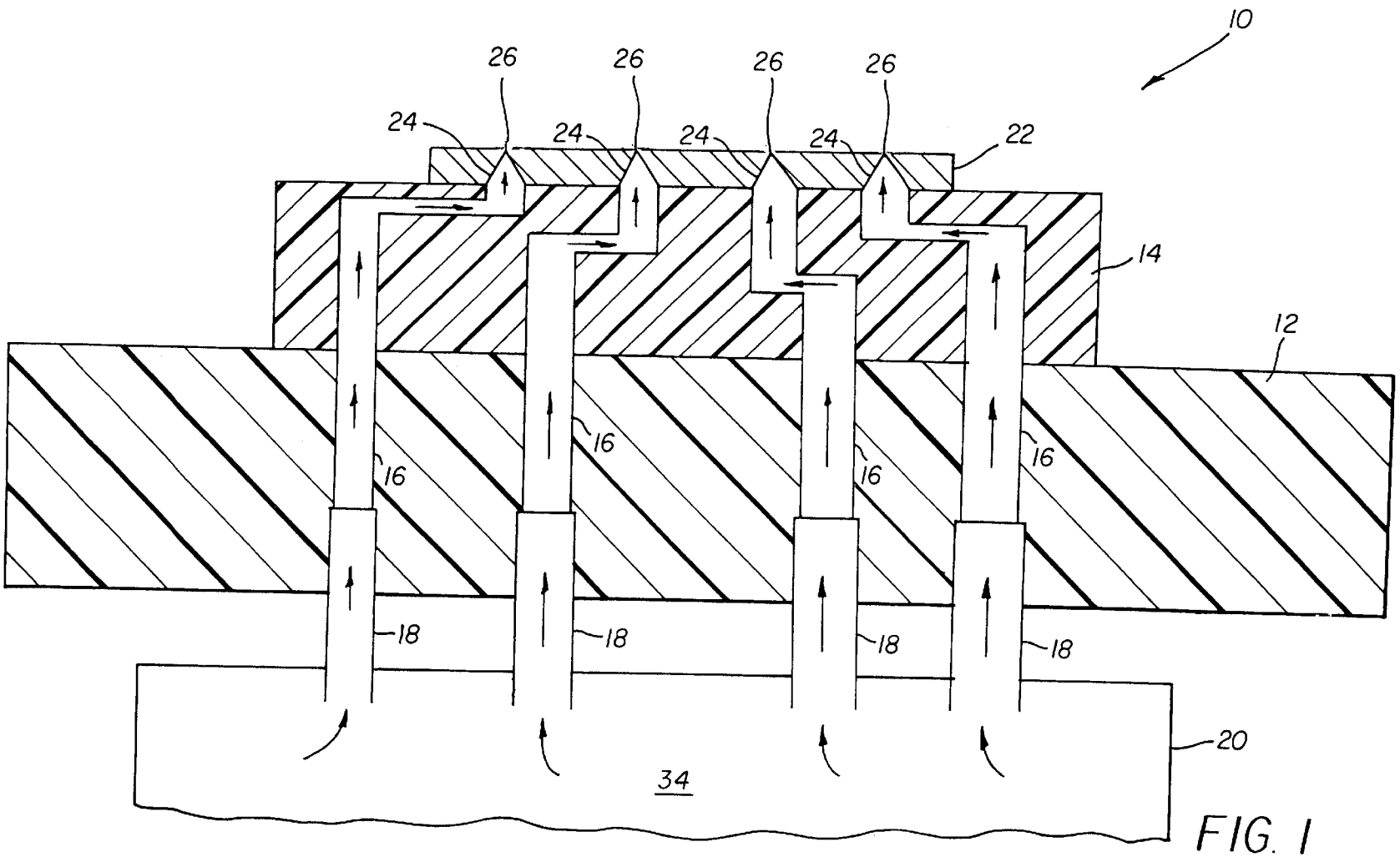
FIG. 1 is a diagram illustrating an inkjet printhead in which a preferred embodiment of the present invention may be implemented.

Referring to FIG. 1, therein is shown an inkjet printhead, denoted generally as 10, to which the active compensation techniques of the present invention can be applied. Inkjet printhead 10 is a device that is most commonly used to direct ink droplets or "drops" onto a receiver medium, such as paper. The ink drops exit rapidly enough so as to form an ink drop stream. As such, the terms "ink drops", "ink droplets", and "ink" will be used interchangeably throughout.

Inkjet printhead 10 includes an ink reservoir 20, fluid-flow channels 18 and inlet/outlet tubes 16 which carry the ink 34 from the reservoir 20 to one or more nozzles 24 and nozzle cavities 32. Ink drops 37 or an ink stream 36 may exit nozzle cavity 32 through nozzle opening 26. Inkjet printhead 10 also comprises a mounting block 12, a gasket manifold 14, and a substrate 22. Substrate 22 is attached to the gasket manifold 14, which, in turn, is bonded to the mounting block 12 in order to form the sub-assembly of inkjet printhead 10. The mounting block 12 and the gasket manifold 14 form a delivery system via fluid flow channels 18 which are defined within. The fluid flow channels 18 provide a route for the ink 34 to exit the nozzles 24 through their respective nozzle openings 26. Each of the nozzle openings 26 may be referred to as an "orifice" and these terms will be interchangeable throughout. Those skilled in the art will appreciate that the figures referred to herein are not drawn to scale and have been enlarged in order to illustrate the major aspects of the inkjet printhead 10. A scaled drawing would not show the fine detail necessary to portray and understand the present invention.

Figure 2A:
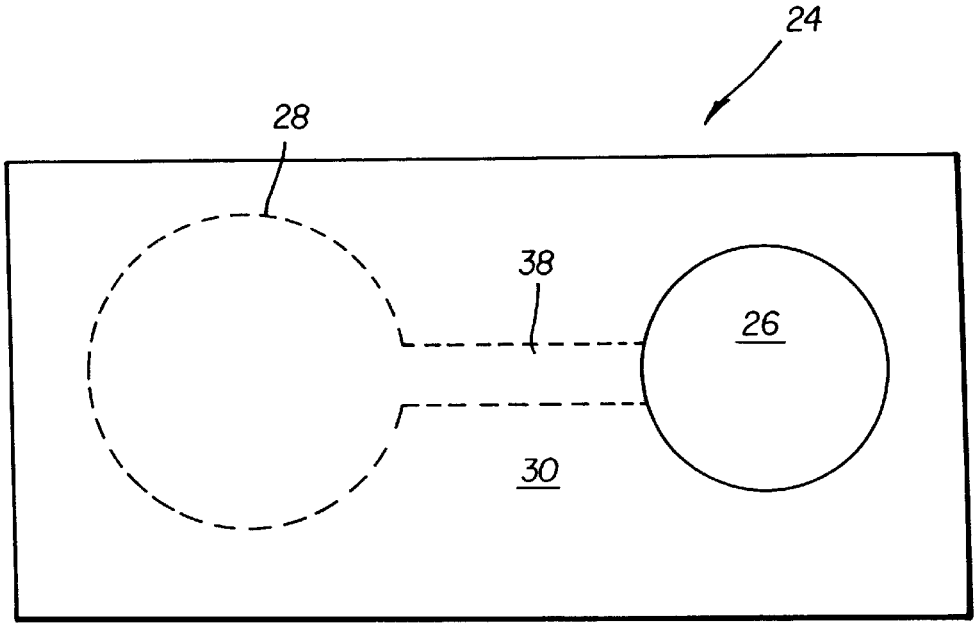
FIG. 2*a* shows a top view of a nozzle and nozzle opening of an inkjet printhead, in accordance with a preferred embodiment of the present invention.
Figure 2B:
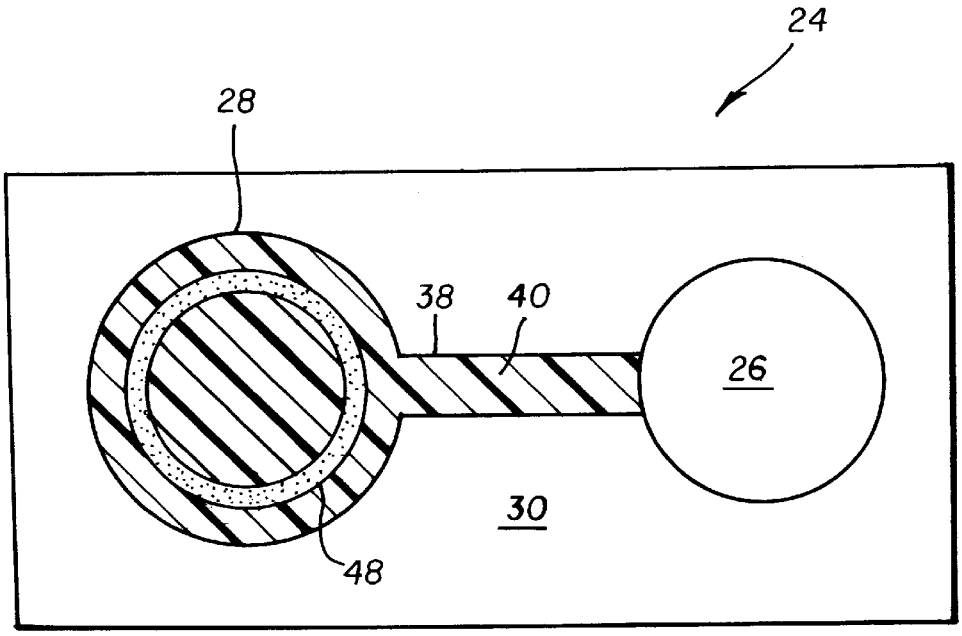
FIG. 2*b* shows a top view of the nozzle of FIG. 2*a* including a channel and reservoir filled with a hardening substance, in accordance with a preferred embodiment of the present invention.
Figure 2C:
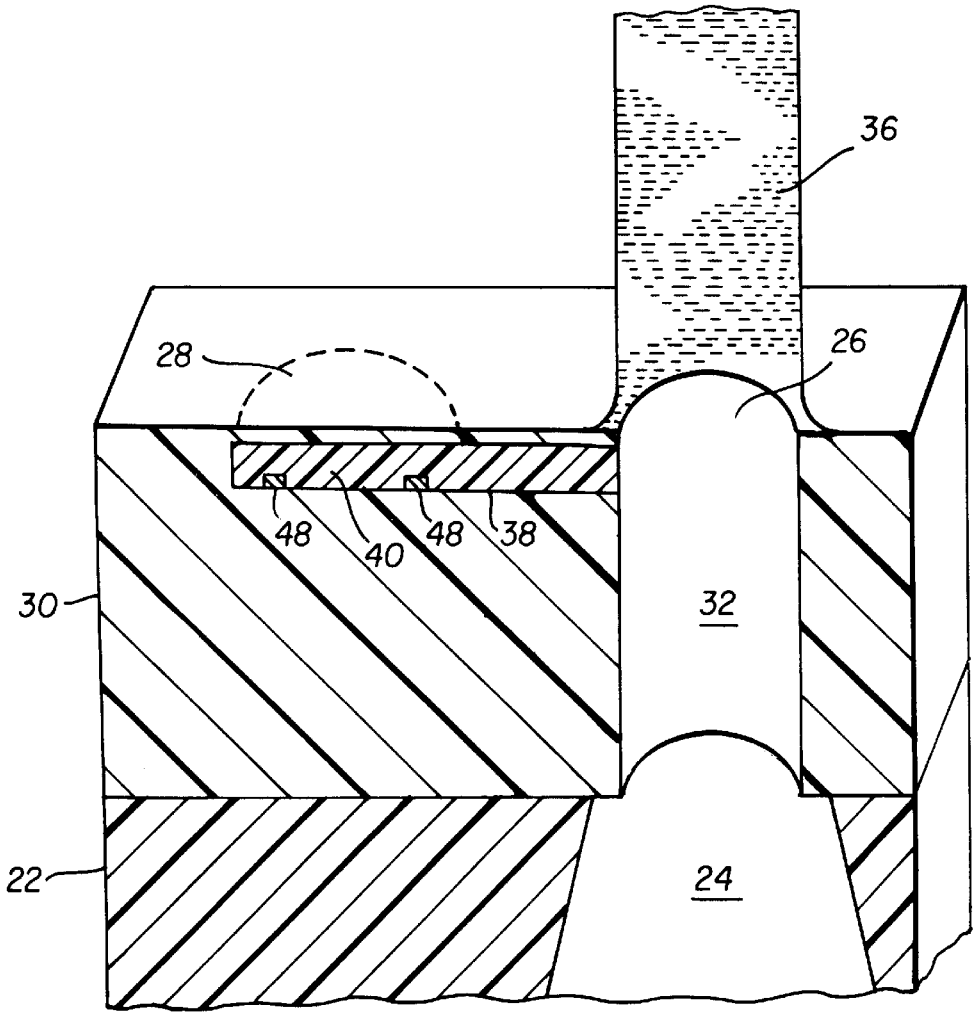
FIG. 2*c* is a cross-section of the nozzle cavity and reservoir of FIG. 2*b,* in accordance with a preferred embodiment of the present invention.

FIGS. 2*a*–2*c* illustrate a nozzle adapted for active compensation in accordance with a preferred embodiment of the present invention. FIG. 2*a* shows a top view of a nozzle 24 and a nozzle opening 26 in membrane 30 of an inkjet printhead, such as printhead 10. FIG. 2*b* illustrates a top view of nozzle 24 showing a reservoir 28 filled with a hardening substance 40, internal heater 48 and nozzle opening 26 in membrane 30 of FIG. 2*a*. As shown, reservoir 28 is integrated within the membrane 30. A channel 38, extending from the reservoir 28 and terminating in nozzle cavity 32, is formed within membrane 30, as shown in FIG. 2*c*. The hardening substance 40, such as a plastic material with a high thermal expansion coefficient, initially fills both the reservoir 28 and channel 38. It is also a preferred embodiment that the reservoir 28 be located directly in contact with the nozzle cavity 32, so that there is no need for the channel 38. Within the reservoir 28 and adjacent the hardening substance 40 is an internal heater 48, which is adapted to cause the hardening substance 40 to flow. This allows for the nozzle cavity space 32*a,* as shown in FIG. 2*c,* to be modified in order to compensate for misdirection of ink drops 37 ejected through nozzle opening 26.

In accordance with the current invention, a hardening material is a material which softens and flows at an elevated temperature, for example at a temperature of from 20 to 200 degrees C. above ambient, or which undergoes a solid liquid phase transition, melting over a similar temperature range. A material which flows typically has a viscosity of less than ten thousand centipoise. Preferably at ambient temperature, a hardening material cannot flow readily. For example, a material having a viscosity of more than a million centipoise cannot be made to flow readily. Preferably, hardening materials also have large temperature coefficients of thermal expansion, for example coefficients of at least 2 parts per million per degree C. Materials such as metals or alloys, for example Woods metal or elemental gallium and its binary alloys, are excellent candidates for inorganic hardening materials. Organic materials, especially polymers such a polystyrene, poly (Bisphenol A carbonate), polyacenaphthylene, poly (methyl acrylate), poly (methyl methacrylate), copolymers such as poly (Bisphenol A carbonate-co-4,4'-(3,3,5-trimethyl cyclohexylidene) diphenol carbonate), and poly (methyl methacrylate-co-ethyl acrylate), and waxes of low molecular weight polyethylene are also excellent hardening materials. These polymeric materials have well known softening points or glass transition temperatures of from 10 C. to 150 C. Other materials capable of being softened by heat may also comprise hardening materials and may have material properties not constrained to the preferred ranges given above.

With reference to FIG. 2*c,* substrate 22 forms a wall, which defines the nozzle 24 below nozzle cavity 32. Nozzle cavity 32 is adapted for facilitating the flow of ink 34 from an ink reservoir 20. A membrane 30 is predisposed over the nozzle 24 to create a resistive barrier against ink flow. Furthermore, membrane 30 includes a nozzle opening 26 through which ink 34 is ejected. In operation, ink 34 from the nozzle cavity 32 is ejected though the nozzle opening 26 and travels in an ink stream 36 or is ejected through nozzle opening 26 in the form of discreet ink drops 37. The nozzle cavity 32 and nozzle opening 26 serve to guide the ink stream 36 in the desired direction.

In continuous inkjet printing, at a distance removed from the printhead 10, the ink stream 36 breaks up into ink drops 37 travelling in the same direction as the ink stream 36. In this case, inkjet printhead 10 causes the ink stream 36 and discreet ink drops 37, which result from the breakup of ink stream 36, to be directed in a printing direction or in a non-printing direction. In continuous inkjet printing, ink is recycled from the non-printing direction using a gutter assembly (not shown) that directs the ink 34 to a recycling unit (not shown). Thus, ink 34 travels from the ink reservoir 20 through the fluid flow channels 18 to the inlet/outlet tubes 16, as shown in FIG. 1, in order to exit the nozzle opening 26, as shown in FIG. 2*c.* In the case of drop-on-demand printing, discreet ink drops 37 are directly ejected from nozzle openings 26.

For printheads having many nozzles with associated nozzle openings, each similar to the nozzle 24 shown in FIGS. 2*a* (top view) and 2*c* (cross-section of FIGS. 2*a*–2*b*), a percentage of the nozzles (typically 1–5%) eject ink drops 37 in a direction that creates undesirable printing artifacts. The desired direction comprises an ink stream 36 exiting the nozzle opening 26 perpendicular to the top surface of the inkjet printhead 10. The desired direction is usually normal to the substrate 22 on which the inkjet printhead 10 is built.

A manufacturing defect, such as a non-symmetrically etched nozzle 24, nozzle cavity 32 or nozzle opening 26, or a misalignment between nozzle opening 26 and nozzle 24 (not shown), can exist in the configuration of nozzle 24, resulting in ink stream 36 being misdirected as it exits nozzle 24. Therefore, it is desired, in accordance with the present invention, to provide a means for compensating for such misdirection. To this end, device and hardware means are provided for adjusting the direction of ink 34 ejected from nozzle openings 26. In accordance with the present invention, ink stream 36 can be adjusted, not just in one direction, but also arbitrarily in any direction by modifying the nozzle cavity 32, as described below.

Initially, each inkjet printhead 10 is tested to determine if it needs compensation. That is, the ink stream directionality is determined via ink 34 ejected onto a receiver medium from a nozzle opening 26. This allows the amount of misdirection of the ink drops 37 ejected from a nozzle 24 of the inkjet printhead 10 caused by manufacturing defects to be identified. Furthermore, variability in the direction of the ink drops 37 ejected from the nozzle 24 assists in determining how much correction to apply in order to avoid discarding the printhead 10.

Here, the error in manufacturing is one that introduces a misdirected ink steam 36 or misdirected ink drops 37 ejected from nozzle 24 of inkjet printhead 10. Therefore, according to the preferred embodiment of the present invention, a reservoir 28 having at least one internal heater 48 is integrated in the membrane 30 and includes a channel 38 which creates a pathway from the reservoir 28 to the nozzle cavity 32, both reservoir 28 and channel 38 initially filled with a hardening substance 40, or plastic material, in order to compensate for the effects of the manufacturing defect.

Figure 3A:
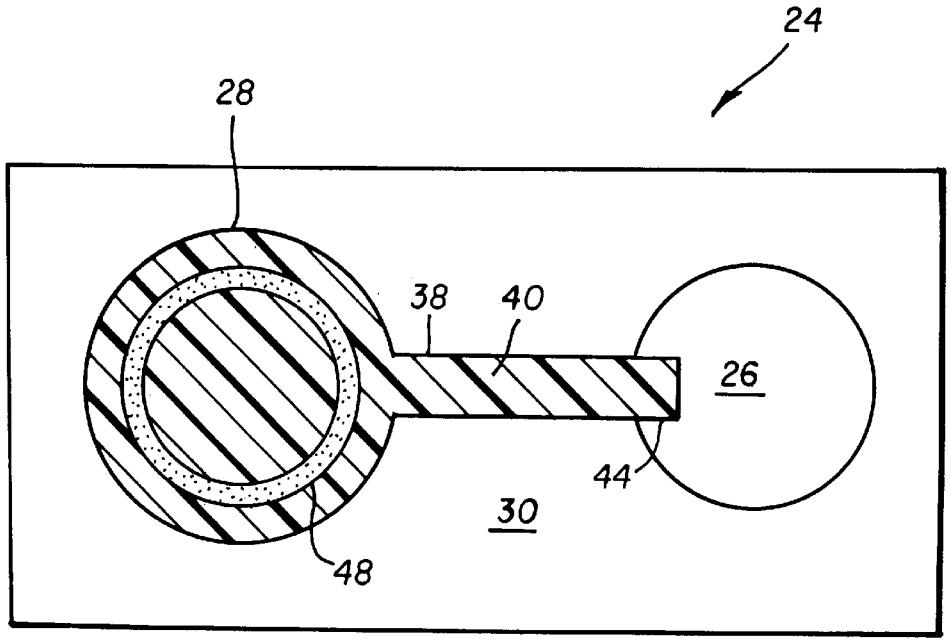
FIG. 3*a* shows a protrusion of the hardening substance resulting in the decrease of nozzle cavity space, in accordance with a preferred embodiment of the present invention.
Figure 3B:
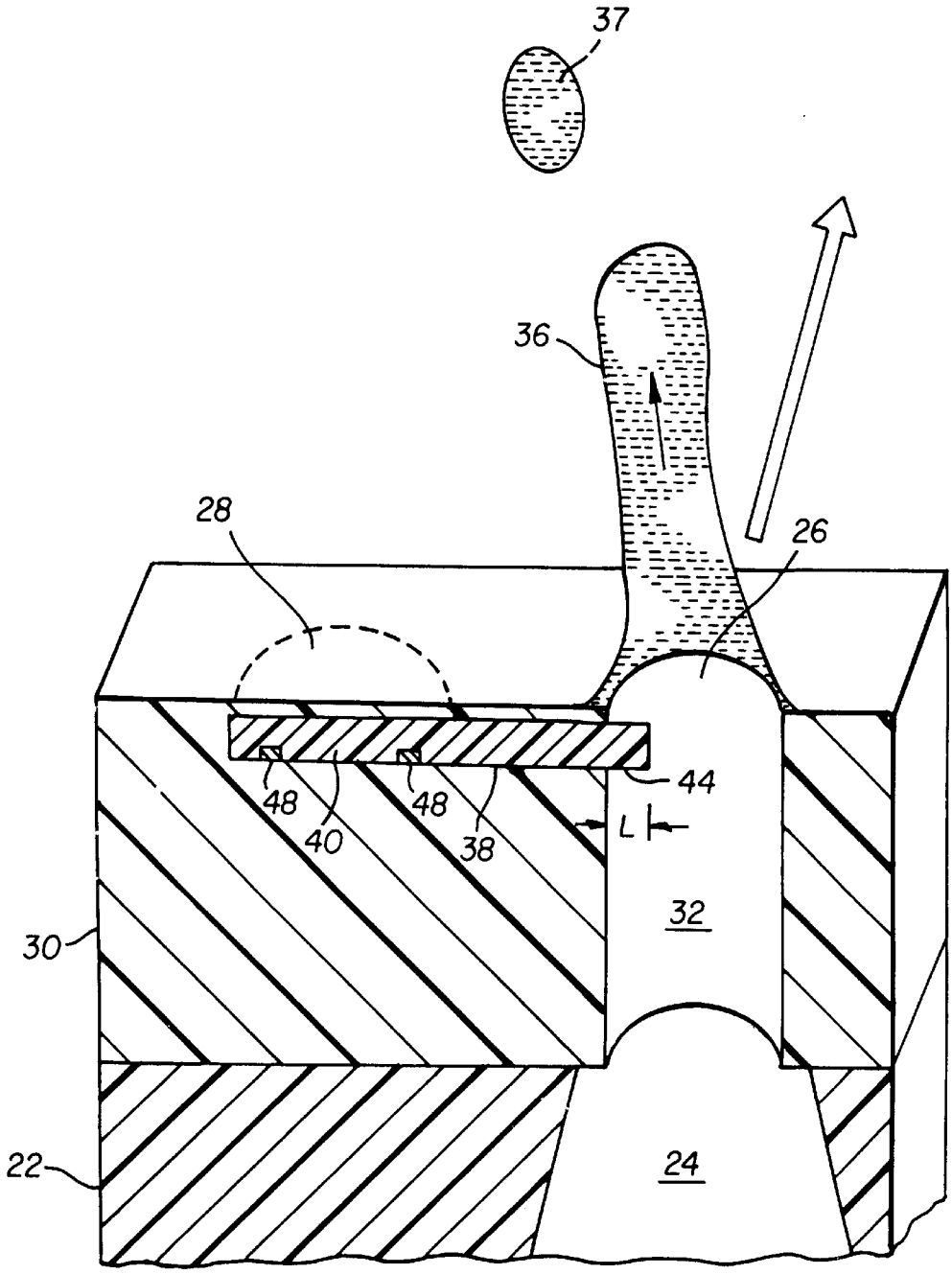
FIG. 3*b* depicts a cross-section of FIG. 3*a,* in accordance with a preferred embodiment of the present invention.

In one embodiment, as shown in FIG. 3*a* and FIG. 3*b,* the hardening substance 40, or plastic material having a high thermal expansion coefficient, within the reservoir 28 is first heated by heater 48. Heat from heater 48 increases the temperature of the hardening substance 40, first in the reservoir 28 where the heater 48 is located and later in channel 38, further from heater 48, causing the plastic material 40 in the reservoir 28 and the channel 38 to soften and expand, thereby producing a protrusion 44 of the hardening substance 40 from channel 38 into nozzle cavity 32, as illustrated in FIG. 3*a*. The length "L" of the protrusion 44 becomes larger as the temperature rises caused by heater 48. The expansion of protrusion 44 results from the fact that thermally induced expansion of certain materials increases with temperature. Thereby, as shown in FIG. 3*a* and in the cross-section of FIG. 3*b,* the nozzle cavity 32 has been modified so as to compensate for the effects of defects in the printhead 10 in order to alter the direction of ink 34 ejected from nozzle 24.

Next, heater 48 is turned off slowly, causing the plastic material 40 to harden first in channel 38, furthest from the heater 48, and finally in reservoir 28, where heater 48 is located. When the hardening substance 40 cools sufficiently in channel 38 it no longer flows, even during the subsequent cooling of the hardening substance 40 in reservoir 28 and channel 38. Thereby, at least a portion of protrusion 44 of the hardening substance 40 remains in nozzle cavity 32. As shown in the cross-section of FIG. 3*b,* the fact that the space in nozzle cavity 32 is decreased causes the ejected ink stream 36 to be deflected with regard to the desired amount of compensation. Table 1 shows the change in deflection of ejected ink drops 37, measured in degrees, for different values of a protrusion 44 of the hardening material 40 into a nozzle cavity 32 measured at 8.0 microns in diameter. Here, the protrusion 44 extends around one side of the nozzle cavity 32, the depth of the channel 38 is 4.0 micron, and the top of channel 38 is 0.5 micron below the top of the nozzle opening 26. A negative value of the protrusion 44 corresponds to a recession 42 of the hardening material 40 away from the wall of the nozzle cavity 32. A negative value of the deflection angle corresponds to a deflection of the ejected drops toward the side of the nozzle cavity containing protrusion 44. These values, while typical for the preferred embodiments described, depend sensitively upon the exact nozzle geometry. Heaters 48 and 50 can be, for example, made of thin film resistive metals such as titanium or tantalum nitride and positioned at the bottom of reservoir 28 and channel 38, or just below the reservoir 28 and channel 38 and can be heated by passing a current through them, as is well known in the art of think film fabrication. For purposes of illustration, it is assumed that in the absence of protrusion 44, ink 34 is ejected in a direction shown by the arrow in FIG. 3*b* due, for example, to a manufacturing defect.

TABLE 1

| PROTRUSION (Microns) | DEFLECTION ANGLE (Degrees) |
|---|---|
| 0.2 | −1.2 |
| 0.1 | −0.8 |
| 0.05 | −0.4 |
| 0 | 0 |
| −0.05 | +0.4 |
| −0.1 | +0.9 |
| −0.2 | +1.8 |

Figure 4A:
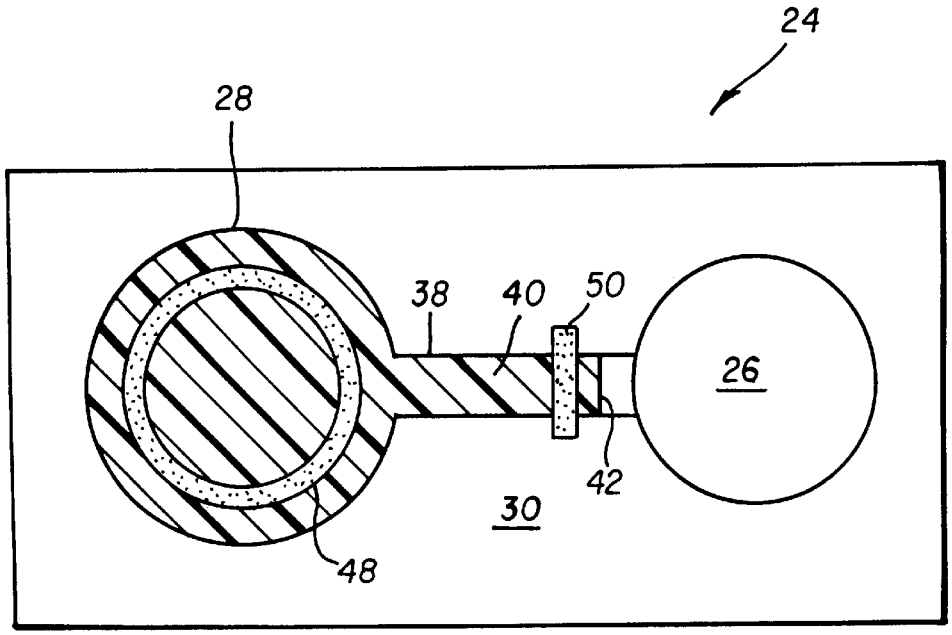
FIG. 4*a* shows a recession of the hardening substance resulting in the increase of nozzle cavity space, in accordance with a preferred embodiment of the present invention.
Figure 4B:
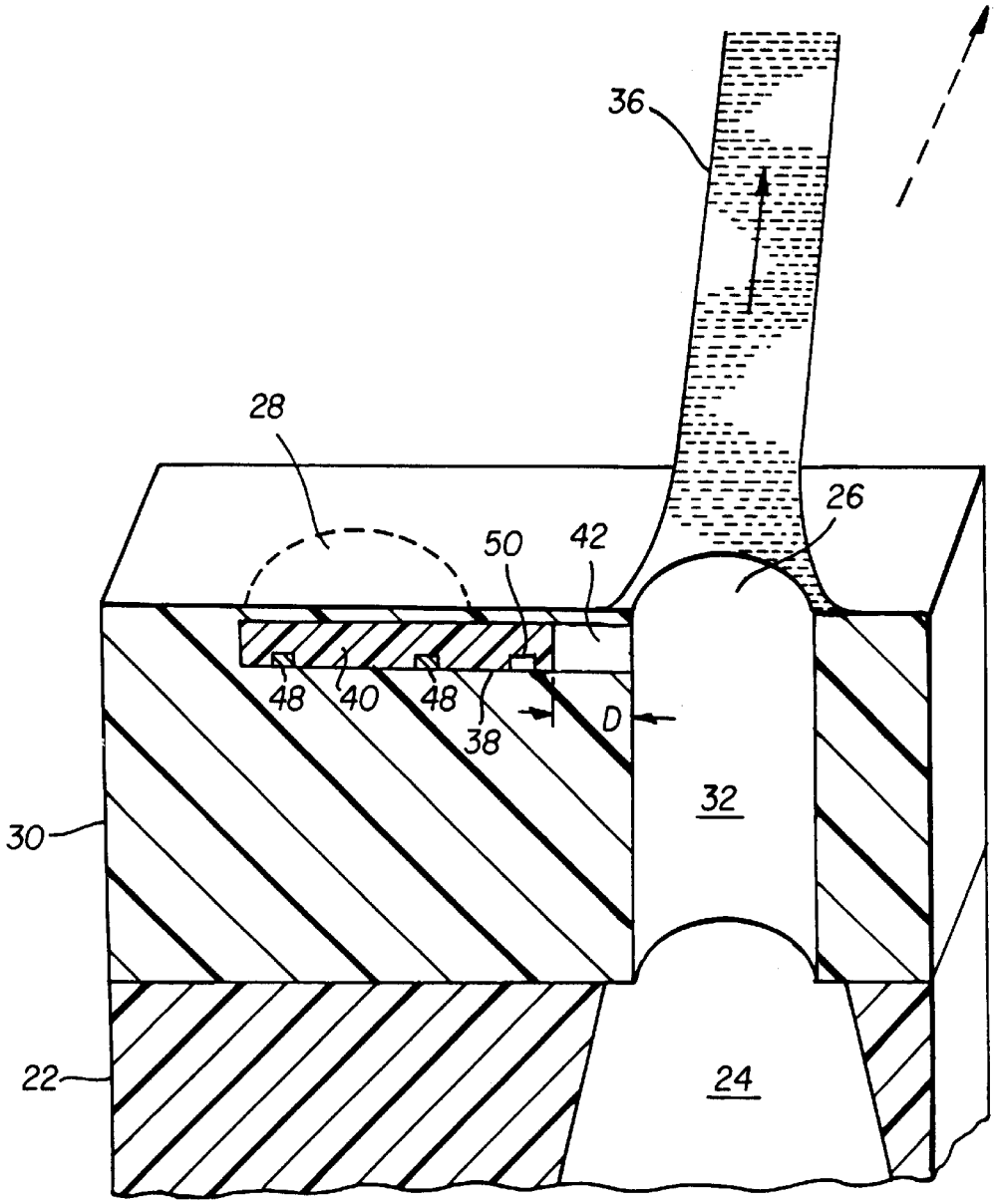
FIG. 4*b* illustrates a cross-section of FIG. 4*a,* in accordance with a preferred embodiment of the present invention.

Similarly, in a related preferred embodiment shown in FIGS. 4*a* and 4*b,* a reservoir 28 having an internal heater 48 is integrated within membrane 30. A channel 38 extending from the reservoir 28 and terminating in the nozzle cavity 32 having a channel heater 50 is further integrated within membrane 30. Channel 38 creates a pathway from the reservoir 28 to the nozzle cavity 32. A hardening substance 40, or plastic material having a high thermal expansion coefficient, fills the reservoir 28 and channel 38 initially. In this case, a recession 42 of the plastic material 40 at a distance "D" away from the edge of the nozzle cavity 32 is shown, the recession 42, having been formed during manufacture of nozzle 24, for example, by plasma etching the plastic material 40 where it is exposed to the nozzle cavity 32, preferably using an oxygen plasma, starting from the structure of FIG. 2*c,* as is well known in the art of microstructure fabrication.

As shown in FIG. 4*b,* ink 34 ejected from nozzle opening 26 and nozzle cavity 32 does not travel vertically, due to recession 42. However, if all nozzles are identically fabricated, the direction of ink 34 ejected from each nozzle, such as nozzle 24, is identical, and the fact that the direction is not vertical is of no consequence, as is well known in the art of inkjet printing. For this example, the direction shown in FIG. 4 can be considered to be the desired direction.

In order to accomplish the alteration of direction of ink 34 ejected from nozzle opening 26 for a particular nozzle, such as nozzle 24, found to have a direction of ink 34 ejection differing from the desired direction resulting from, for example, a manufacturing defect, the nozzle cavity 32 of that nozzle requires modification. According to the invention, modification is accomplished namely by adjustment of the distance "D" in FIG. 4*b*. For example, in FIG. 4*b,* the dotted arrow illustrates the direction of ink 34 ejected in a non-desired direction due to a defect.

Figure 4C:
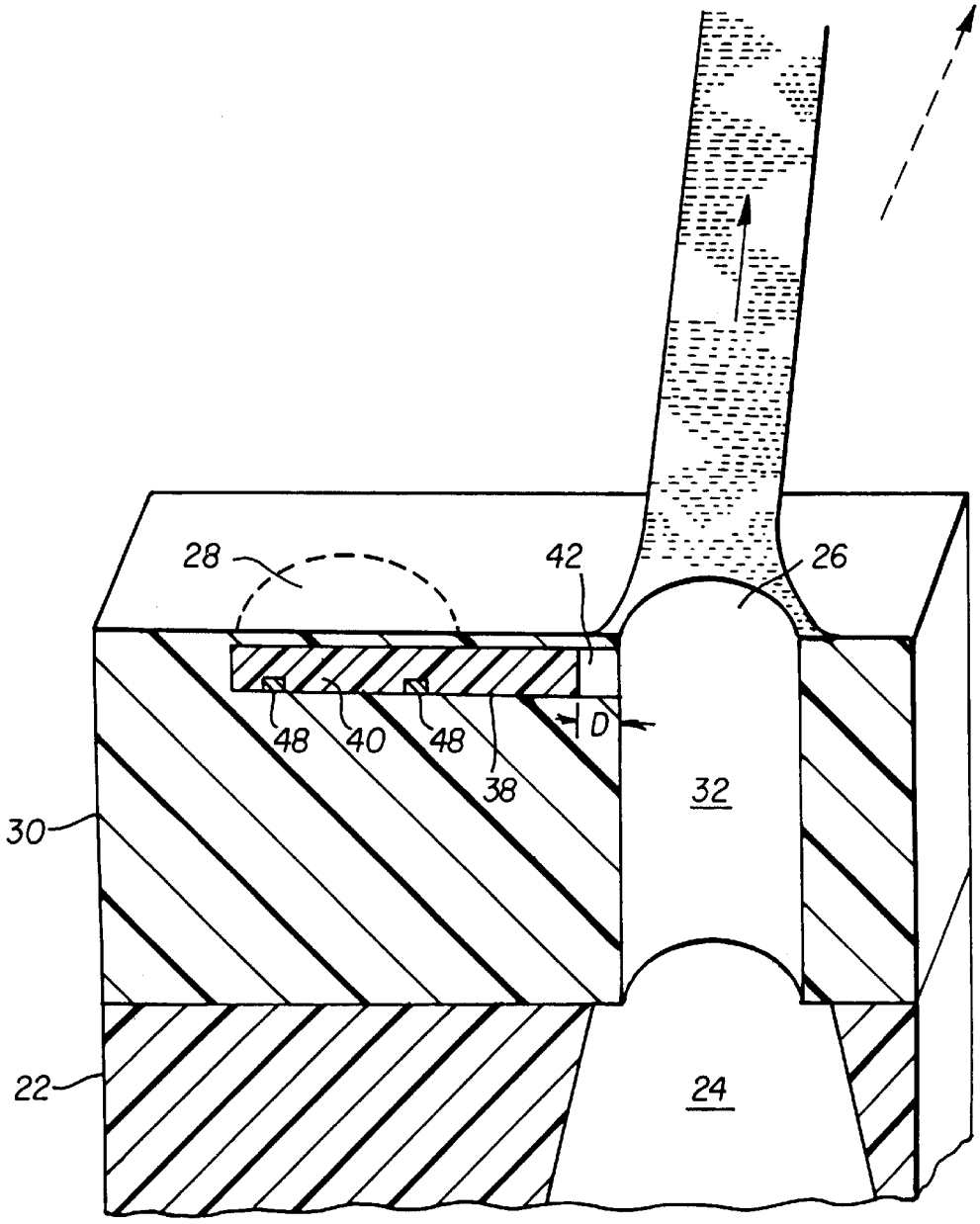
FIG. 4*c* illustrates a cross-section of FIG. 4*a,* in accordance with a preferred embodiment of the present invention, after compensation for misdirection of ejected ink.

In operation, internal heater 48 within or adjacent reservoir 28 and channel heater 50 within or adjacent channel 38, both adjacent hardening substance 40, are activated sequentially. Initially, both heaters 48, 50 are activated and the temperature of the hardening substance 40 increases in reservoir 28 and channel 38. When the hardening substance 40 in reservoir 28 and channel 38 soften and expand, the distance "D" decreases, wherein the amount of decrease depends on the temperature of the hardening substance 40. Next, channel heater 50 is turned off, causing the hardening substance 40 in channel 38 to cool. When the hardening substance 40 cools sufficiently in channel 38, it no longer flows, even during the subsequent cooling of hardening substance 40 in reservoir 28. Finally, the reservoir heater or internal heater 48 is also turned off. Thereby, as shown in FIG. 4*c,* the nozzle cavity 32 has been modified, the distance "D" having been made smaller so as to compensate for the effects of defects in printhead 10 in order to alter the direction of ink 34 ejected from nozzle 24. The change in the distance "D" is large, decreasing "D" a large amount when the hardening substance 40 in reservoir 28 is at a high temperature when channel heater 50 is turned off, causing the hardening substance 40 in channel 38 to cool. The change in the distance "D" is smaller when the hardening substance 40 in reservoir 28 is at a low temperature when channel heater 50 is turned off, causing the hardening substance 40 in channel 38 to cool. Therefore, after an operation described above in which "D" is made very small by using a high reservoir temperature, a subsequent operation using a lower reservoir temperature will cause "D" to be increased. In this sense, "D" may be either increased or decreased, as can be appreciated by one skilled in the art of material softening and flow.

As is well known in the art of modeling fluid flow, such protrusion causes a deflection of the ejected ink stream 36 (e.g., continuous inkjet devices), or of the direction of discreet ink drops (e.g., drop-on-demand devices). This deflection can be used to compensate misaligned nozzles, such as nozzle 24, as described in the previous embodiments. While it is advantageous that the heaters 48, 50 need not be activated continuously whenever compensation is required, it is possible to effect compensation by leaving the heaters 48, 50 on at all times. In this case, the temperature of the hardening substance 40 in reservoir 28 and channel 38 is always such that the hardening substance 40 can flow, and the distance "D" may be changed by changing the temperature in the reservoir 28 and channel 38 at any time, for example, by changing the amount of current flowing through the heaters 48,50 in the case where they are thin film resistors.

Figure 5A:
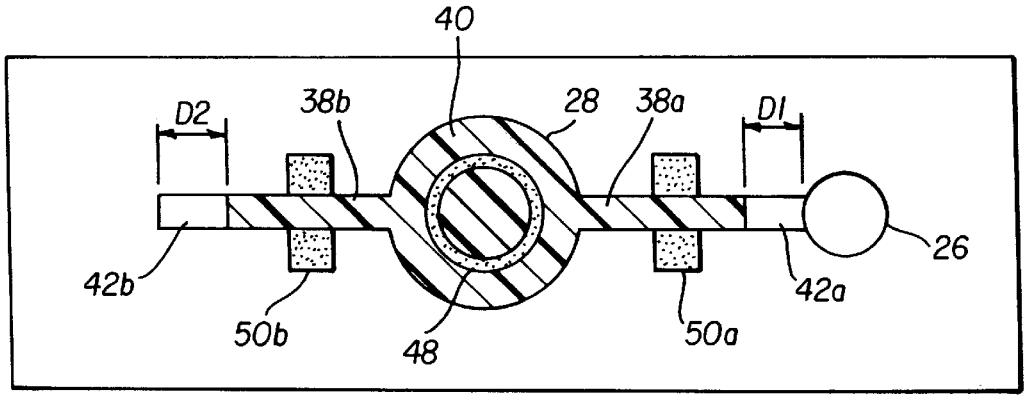
FIG. 5*a* illustrates a top view of a nozzle having a reservoir and two channels, in accordance with a preferred embodiment of the present invention.

Furthermore, in another embodiment, shown in FIGS. 5*a*–5*d,* the distance "D" of FIGS. 4*a*–4*c* may be changed in either direction. Reservoir 28, having an internal heater 48, is integrated within membrane 30. Two channels, 38*a* and 38*b,* are integrated within membrane 30 having channel heaters 50*a* and 50*b* respectively, similar to channel heater 50 of FIG. 4*a,* with channel 38*a* extending from reservoir 28 and terminating in nozzle cavity 32. Channel 38*b* extends away from reservoir 28 and is further integrated within membrane 30. Channel 38 a creates a pathway from the reservoir 28 to the nozzle cavity 32. A hardening substance 40, or plastic material having a high thermal expansion coefficient, fills the reservoir 28 and channels 38*a* and 38*b* initially as shown in FIG. 5*a*. In this case, a recession 42*a* of the plastic material 40 at a distance "D1" away from the edge of the nozzle cavity 32 is shown, as well as a recession 42*b* at a distance "D2" away from the end of channel 38*b*, the recessions having been formed during manufacture of the nozzle 24, for example by plasma etching, preferably using an oxygen plasma, as is well known in the art of microstructure fabrication.

Figure 5B:
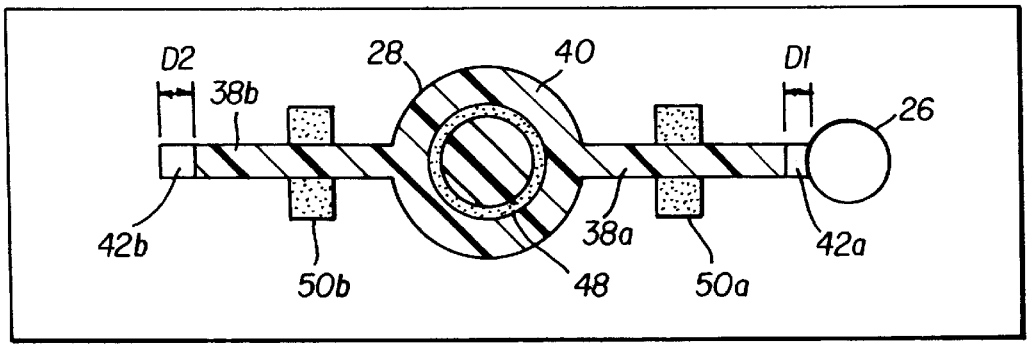
FIG. 5*b* illustrates a top view of the nozzle of FIG. 5*a* during operations, in accordance with one embodiment of the present invention.
Figure 5C:
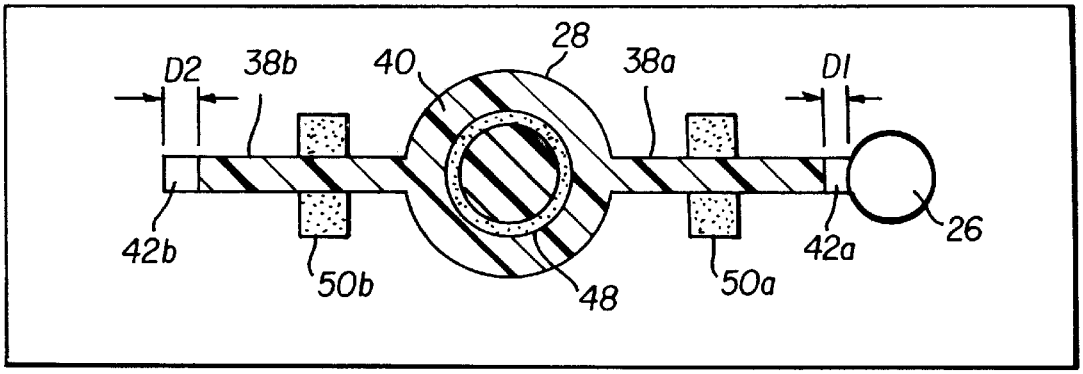
FIG. 5*c* illustrates a top view of the nozzle of FIG. 5*a* during operations, in accordance with one embodiment of the present invention.
Figure 5D:
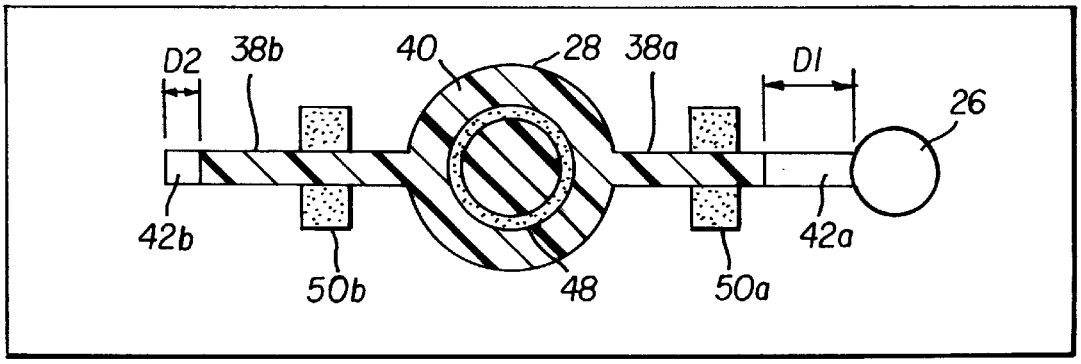
FIG. 5*d* illustrates a top view of the nozzle of FIG. 5*a* during operations, in accordance with one embodiment of the present invention.

As shown in FIGS. 5*b*–5*d*, the distance "D2" can be altered by sequential operation of heaters 48, 50*a* and 50*b*. In FIG. 5*b*, all heaters have been activated and the hardening substance 40 has uniformly expanded, decreasing both "D1" and "D2." In FIG. 5*c*, heater 50*b* has been turned off and the hardening substance 40 in channel 38*b* has cooled and is no longer free to flow. Thereby, the distance "D2" remains substantially fixed. In FIG. 5*d*, reservoir heater 48 has been turned off, but channel heater 50*a* remains on, thus the material in reservoir 28 is shown contracted and the distance "D1" is shown increased, as is known in the art of plastic flow. Finally, in FIG. 5*e*, all heaters are shown off, and the distance "D1" is now substantially fixed since the hardening substance 40 is no longer free to flow. "D1" in FIG. 5*e* is slightly larger than "D1" in FIG. 5*d* since the hardening substance 40 in channel 38*b* has cooled, but this effect is smaller than the change in "D1" when reservoir 28 cools, as the amount of hardening substance 40 in reservoir 28 is larger than that in channel 38*b*, as can be appreciated by one skilled in the art of plastic flow.

Figure 5E:
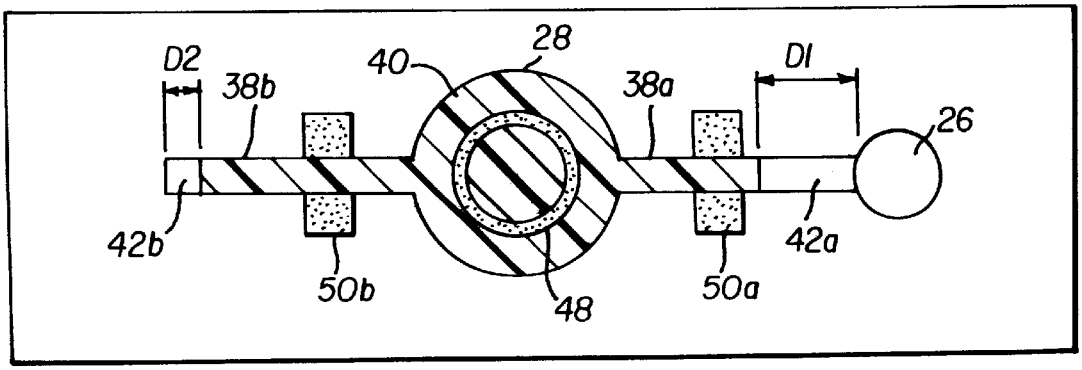
FIG. 5*e* illustrates a top view of the nozzle of FIG. 5*a* after operations, in accordance with a preferred embodiment of the present invention.

As seen by comparing FIGS. 5*a* and 5*e*, the body of hardening substance 40 in reservoir 28 and channels 38*a* and 38*b* has moved to the left, the volume of material being substantially the same. Thereby, as shown in FIG. 5*e*, nozzle cavity 32 has been modified, the distance "D1" having been made larger, so as to compensate for the effects of defects in the printhead 10 in order to alter the direction of ink 34 ejected from nozzle 24. As can be appreciated by one skilled in the art of plastic flow, while the reservoir 28 and heater 48 are useful in allowing large changes in the distance "D1," they are not required to have the circular shape shown. For example, if the reservoir is the same shape as the channels 38*a* and 38*b*, and the heater 48 is disposed similarly to heaters 50*a* and 50*b*, then "D1" can still be changed by operating heaters 48, 50*a* and 50*b* in the same sequence described above, or in closely related sequences obvious to one skilled in plastic flow. Further, by reversing the operations of the heaters 50*a* and 50*b*, the distance "D1" can be decreased. Thus, the value of "D1" can be either increased or decreased using the same device structure by a different sequence of operations.

While the hardening material 40 has been described as softening when heated, it is also advantageous in the embodiments, particularly when large changes in the distance from the hardening material 40 in the channel 38 to the nozzle cavity 32 are desired, that the hardening material 40 be chosen of a type which undergoes a liquid-solid phase transition when heated, for example a wax or a metal which melts near room temperature. It can also be appreciated that different hardening materials 40 may interact in different ways with the walls of the channels, depending upon the material of which the walls are made or with which the walls may be coated. For example, in the case of the hardening material 40 being a wax and the walls of the channels 38*a* or 38*b* being glass, the hardening material may adhere to the walls so strongly as to allow formation of a very thin coating of the hardening material over all the channel walls, even on the walls of recessions 42*a* or 42*b*. In this case, such a thin coating may be regarded as essentially a part of the wall of channel itself. In other cases, for example in the case where the hardening material 40 is a metal or a molten metal and the walls of the channel are coated with a fluorinated hydrocarbon, the hardening material may fail totally to adhere to the channel walls.

It is also to be appreciated that while the configuration of the nozzle 24, nozzle cavity 32, and nozzle opening 26 has been described in terms of a membrane 30 having an opening and overlying a substrate 22, this particular configuration is not required in the practice of the current invention, which relies on a change in the shape of the region through which ink 34 flows near the ink exit opening. As can be appreciated by those knowledgeable in the construction of currently practiced inkjet printheads, for example, the substrate 22 and membrane 30 could be made of a single material, or the size of the nozzle 24 and nozzle cavity 32 could be identical where they meet. If both of these conditions are met, then the nozzle cavity 32 whose space is altered to compensate ink drop 37 misdirection can be made as part of the substrate 22. Alternatively, the walls of the nozzle 24 could be vertical, rather than sloped, or could be curved near the membrane 30. In yet another example, the nozzle cavity 32 could reside directly on the inlet/outlet tube 16.

It can also be appreciated that the walls of the channels 38*a* and 38*b* are in some cases advantageously made rough so that the hardening material can better adhere by varying the width of the channels (the vertical direction in FIG. 5*a*) periodically along the channel length (the horizontal direction in FIG. 5*a*) so that the hardening material when not softened cannot slide along the length.

It can also be appreciated that means other than electrical heating can be employed to heat and cool hardening material 40, for example light from a light emitting diode or laser could also be employed, such light arising from devices formed integrally on the nozzle substrate or on the membrane 30 or from external sources.

Furthermore, in another embodiment, misalignment in any direction may be compensated by locating multiple reservoirs, each having channels extending into nozzle cavity 32, around the nozzle cavity 32, since it is known in the art of fluid flow that the net deflection arising from multiple deflection means, such as those caused by protruding plastic material, such as hardening substance 40, combine approximately by vector addition.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

PARTS LIST

10 . . . inkjet printhead
12 . . . mounting block
14 . . . gasket manifold
16 . . . inlet/outlet tubes
18 . . . fluid-flow channels
20 . . . ink reservoir
22 . . . substrate, or upper layer
24 . . . nozzle or nozzles

26 . . . nozzle opening, or orifice
28 . . . reservoir
30 . . . membrane
32 . . . nozzle cavity
34 . . . ink
36 . . . ink stream
37 . . . ink drops
38 . . . channel
38*a* . . . channel
38*b* . . . channel
40 . . . plastic material, or hardening substance
42 . . . recession
42*a* . . . recession
42*b* . . . recession
44 . . . protrusion
48 . . . internal heater
50 . . . channel heater
50*a* . . . channel heater
50*b* . . . channel heater

What is claimed is:

1. An inkjet printhead with integral compensation for misdirection of ink drops ejected through at least one nozzle of the printhead comprising:

a nozzle cavity formed in a membrane adapted for facilitating the flow of ink from an ink reservoir to a nozzle opening via an ink pathway, said membrane including said nozzle opening through which ink drops are ejected;

at least one reservoir integrated within said membrane, a hardening substance within said reservoir; and an internal heater within or adjacent said reservoir adjacent said hardening substance, said internal heater adapted to cause said hardening substance to flow;

wherein said hardening substance is adapted to internally alter said nozzle cavity and cause ink ejected from said nozzle opening to be deflected with regard to a desired amount of compensation.

2. The inkjet printhead according to claim 1 wherein said membrane further comprises a channel extending from said reservoir and terminating in said nozzle cavity.

3. The inkjet printhead according to claim 2 wherein said hardening substance extends within at least a portion of said channel.

4. The inkjet printhead according to claim 3 wherein said hardening substance has a protrusion which extends from said channel into said nozzle cavity.

5. The inkjet printhead according to claim 1 wherein said hardening substance is a plastic material having a high thermal expansion coefficient.

6. The inkjet printhead according to claim 1 wherein said printhead further comprises a means for causing said hardening substance to thermally expand, thereby protruding into the nozzle cavity space.

7. The inkjet printhead according to claim 1 wherein said printhead further comprises a means for causing said hardening substance in said channel to recede away from said nozzle cavity.

8. The inkjet printhead according to claim 1 wherein said printhead further comprises a second heater for heating said hardening substance within said channel and which is distinct from said internal heater that heats said plastic material within said reservoir.

9. The inkjet printhead according to claim 8 wherein said second heater is adapted to be deactivated prior to deactivating said internal heater, thereby causing said hardening substance to maintain a protruding state after heating.

10. The inkjet printhead according to claim 1 wherein said printhead further comprises a means for sustaining a temperature change until the desired amount of compensation is obtained.

11. An inkjet printhead with internal means for compensating for misdirection of ink drops ejected through at least one nozzle of the printhead comprising:

a nozzle cavity and nozzle cavity space formed in a membrane adapted for facilitating the flow of ink from an ink reservoir to a nozzle opening, said membrane including a nozzle opening through which ink drops are ejected;

a reservoir integrated within said membrane;

a channel extending from said reservoir and terminating in said nozzle cavity;

a plastic material having a high thermal expansion coefficient; and an internal heater immersed in said plastic material;

wherein said internal heater is configured to cause said plastic material to expand and modify the nozzle cavity space.

12. The inkjet printhead according to claim 11 wherein said plastic material is a material that undergoes a phase change when heated.

13. The inkjet printhead according to claim 12 wherein said channel is formed entirely within said membrane.

14. The inkjet printhead according to claim 11 wherein said reservoir and channel are initially filled with said plastic material.

15. The inkjet printhead according to claim 11 wherein said internal heater is predisposed within said reservoir, said internal heater being circular in shape.

16. The inkjet printhead according to claim 11 wherein said plastic material is adapted to form a protrusion in said nozzle cavity, thereby decreasing said nozzle cavity space.

17. The inkjet printhead according to claim 11 wherein said inkjet printhead further comprises a second heater for heating said plastic material within said channel.

18. The inkjet printhead according to claim 17 wherein said plastic material is adapted to form a recession in said channel, thereby increasing said nozzle cavity space.

19. For an inkjet printhead having at least one reservoir with a channel, said channel creating a pathway from said reservoir to a nozzle cavity of a nozzle terminating in a nozzle opening, a method of compensating for the effects of a defect in the printhead comprising the steps of:

determining that compensation in ejection of a liquid from said nozzle opening is desired; and modifying the nozzle cavity with a hardenable material that flows when soft between said reservoir and said channel and the nozzle cavity and hardening said material in the nozzle cavity to modify the nozzle cavity, the hardenable material being of a different composition than the liquid to be ejected from the nozzle opening.

20. The method according to claim 19 wherein said liquid to be ejected is ink and said determining step is preceded by the step of testing said inkjet printhead to determine ink stream directionality onto a receiver medium from the nozzle opening.

21. The method according to claim 20 wherein said testing step is followed by the step of identifying variability in the direction of ink drops ejected from the nozzle of said inkjet printhead caused by manufacturing defects.

22. The method according to claim 19 wherein said modifying step includes the step of activating a heater associated with said reservoir, heat from said heater causing said hardenable material within said reservoir and channel to protrude into said nozzle cavity.

23. The method according to claim 22 wherein said activating step further includes the step of sustaining a temperature change until a desired amount of compensation is obtained.

24. The method according to claim 23 wherein said cooling step is followed by the step of deactivating said heater causing said hardenable material within said reservoir to harden.

25. The method according to claim 22 wherein said activating step is followed by the step of cooling said hardenable material within said channel in order to harden said hardenable material in a protruding state and decrease said nozzle cavity space.

26. The method according to claim 19 wherein said modifying step further includes the step of cooling the hardenable material within said reservoir causing the hardenable material in said channel to recede and the nozzle cavity space to increase.

27. For an inkjet printhead having at least one reservoir with a channel and a hardenable material in said reservoir and channel, said channel creating a pathway from said reservoir to a nozzle cavity, a method of modifying the nozzle cavity space so as to compensate for the effects of a defect in the printhead by altering the direction of ink drops from a nozzle comprising the steps of:

determining that compensation is desired in the direction of ink ejected from said nozzle opening;

modifying the nozzle cavity space by causing the hardenable material to flow, the hardenable material being of a different composition from that of the ink;

causing ink ejected from said nozzle opening to be deflected in accordance with the compensation obtained through modifying of the nozzle cavity space.

28. The method according to claim 27 further including heating the reservoir and channel to cause the hardenable material to flow to modify the nozzle cavity.

29. The method according to claim 27 wherein said modifying step further includes the step of altering the nozzle cavity by causing motion of the hardenable material away from the nozzle cavity.

30. The method according to claim 27 wherein said modifying step further comprises sequential activation of heaters.

31. A method of adjusting an inkjet printhead for misdirection of ink drops ejected through at least one nozzle of the printhead, the printhead including a nozzle cavity formed in a membrane adapted for facilitating the flow of ink from an ink reservoir to a nozzle opening via an ink pathway, said membrane including said nozzle opening through which ink drops are ejected, at least one reservoir integrated within said membrane and a hardening substance within said reservoir; said method comprising:

heating said hardening substance to cause said hardening substance to flow to alter said nozzle cavity; and ejecting ink from said nozzle opening to be deflected onto a receiver member in accordance with alteration of the nozzle cavity.

32. A method of operating an inkjet printhead, comprising;

providing an inkjet printhead with a plurality of nozzle cavities, each nozzle cavity including a nozzle opening from which ink is ejected, at least some of the nozzle cavities having altered structural configurations from that of other nozzle cavities on the printhead, the altered structural configurations correcting for misdirection of ink drops ejected onto a receiver member; and ejecting ink onto the receiver member from nozzle openings of the printhead to print an image, wherein the altered structural configurations of said at least some of the nozzle cavities causes ink to be ejected towards the receiver member at similar angles relative to ink ejected from nozzle openings of the other nozzle cavities on the printhead, the altered structural configuration of a nozzle cavity of the at least some of the nozzle cavities being formed by a hardenable material that is of a different composition from the ink and which is caused to flow from a reservoir in said printhead to the nozzle cavity.

* * * * *